US012729619B2

(12) United States Patent
Andersson

(10) Patent No.: US 12,729,619 B2
(45) Date of Patent: Sep. 8, 2026

(54) METHOD PERFORMED BY A CONTROL DEVICE FOR CONTROLLING THE FEEDING DISTANCE AND FEEDING RATE IN A ROCK DRILLING UNIT, A ROCK DRILLING UNIT AND A ROCK DRILLING RIG

(71) Applicant: EPIROC ROCK DRILLS AKTIEBOLAG, Örebro (SE)

(72) Inventor: Christer Andersson, Örebro (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 0 days.

(21) Appl. No.: 17/913,221

(22) PCT Filed: Mar. 17, 2021

(86) PCT No.: PCT/SE2021/050236
§ 371 (c)(1),
(2) Date: Sep. 21, 2022

(87) PCT Pub. No.: WO2021/194407
PCT Pub. Date: Sep. 30, 2021

(65) Prior Publication Data

US 2023/0136108 A1 May 4, 2023

(30) Foreign Application Priority Data

Mar. 27, 2020 (SE) ..... 2050340-5

(51) Int. Cl.
*E21B 45/00* (2006.01)
*E21B 19/16* (2006.01)
*E21B 44/02* (2006.01)

(52) U.S. Cl.
CPC ..... *E21B 44/02* (2013.01); *E21B 19/165* (2013.01); *E21B 45/00* (2013.01)

(58) Field of Classification Search
CPC ..... E21B 44/02; E21B 45/00; E21B 19/08; E21B 19/081; E21B 19/083; E21B 7/025;
(Continued)

(56) References Cited

U.S. PATENT DOCUMENTS 3,162,253 A * 12/1964 Curtis ..... E21B 7/022 173/147
3,368,400 A 2/1968 Jorden, Jr. et al.
(Continued)

FOREIGN PATENT DOCUMENTS

CA 2954193 A1 7/2018
CN 101886519 A 11/2010
(Continued)

OTHER PUBLICATIONS

International Search Report and Written Opinion mailed May 31, 2021 for International Application No. PCT/SE2021/050236, 10 pages.
(Continued)

*Primary Examiner* — Kipp C Wallace
(74) *Attorney, Agent, or Firm* — Sage Patent Group

(57) ABSTRACT

The invention relates to a method performed by a control device for controlling a feeding distance and feeding rate in a rock drilling unit. The rock drilling unit comprising: a feeding device for feeding at least one drill rod and a drill bit in an axial direction; a rotating device; and a distance and rate measuring device comprising at least one rotational target wheel configured to be driven by the feeding device and at least one sensor device connected to the control device, the method comprising: controlling the feeding device to move in the axial direction; determining the feeding distance from a first position and the feeding rate of the feeding device from the rotational motion of the at least one rotational target wheel; and controlling the feeding
(Continued)

device depending on the determined feeding distance and feeding rate of the feeding device.

11 Claims, 7 Drawing Sheets

(58) Field of Classification Search
CPC . E21B 7/02; E21B 7/023; E21B 7/022; E21B 7/024; E21B 7/026; E21B 7/027; E21B 7/021
See application file for complete search history.

(56) References Cited

U.S. PATENT DOCUMENTS

| | | | | | |
|---|---|---|---|---|---|
| 3,692,124 | A * | 9/1972 | Kimber | E21B 19/081 | 173/160 |
| 3,898,880 | A | 8/1975 | Kelseaux et al. | | |
| 3,973,634 | A * | 8/1976 | Persson | H02G 11/00 | 173/147 |
| 4,064,749 | A | 12/1977 | Pittman et al. | | |
| 4,156,467 | A | 5/1979 | Patton et al. | | |
| 4,449,592 | A * | 5/1984 | Mayer | E21B 19/20 | 175/57 |
| 4,736,297 | A | 4/1988 | LeJeune | | |
| 5,365,674 | A * | 11/1994 | Etchegoyhen | E21B 47/04 | 33/711 |
| 5,449,047 | A * | 9/1995 | Schivley, Jr. | E21B 44/00 | 175/27 |
| 6,015,112 | A * | 1/2000 | Hakkinen | F16L 3/012 | 242/603 |
| 6,112,834 | A * | 9/2000 | Barrett | E21B 7/02 | 175/162 |
| 7,350,593 | B1 | 4/2008 | Brookover | | |
| 2001/0022238 | A1* | 9/2001 | Houwelingen | E21B 19/08 | 175/27 |
| 2015/0275647 | A1 | 10/2015 | Rolong et al. | | |
| 2015/0376962 | A1* | 12/2015 | Kos | E21B 19/155 | 414/22.54 |
| 2017/0074086 | A1 | 3/2017 | Viitaniemi et al. | | |
| 2020/0056470 | A1* | 2/2020 | Ng | E21B 3/022 | |
| 2021/0017849 | A1* | 1/2021 | Moberg | E21B 47/06 | |
| 2021/0222542 | A1* | 7/2021 | Moberg | E21B 7/022 | |

FOREIGN PATENT DOCUMENTS

| | | | |
|---|---|---|---|
| CN | 102803642 | A | 11/2012 |
| CN | 105221135 | A | 1/2016 |
| CN | 109915014 | A | 6/2019 |
| WO | 2016/148880 | A1 | 9/2016 |

OTHER PUBLICATIONS

Office Action mailed Jan. 18, 2025 for Chinese Patent Application No. 202180022245.2. 9 pages.

Office Action, Chinese Patent Application No. 202180022245.2, mailed Mar. 19, 2026, 15 pages.

"Proceedings of the 20th National Academic Conference on Mineral Exploration Engineering (Geotechnical and Drilling Engineering)", Exploration Engineering Committee of Geological Society of China, Geological Publishing House, dated Aug. 31, 2019, 6 pages.

* cited by examiner

METHOD PERFORMED BY A CONTROL DEVICE FOR CONTROLLING THE FEEDING DISTANCE AND FEEDING RATE IN A ROCK DRILLING UNIT, A ROCK DRILLING UNIT AND A ROCK DRILLING RIG

CROSS-REFERENCE TO RELATED APPLICATIONS

This application is a 35 U.S.C. § 371 national stage application for International Application No. PCT/SE2021/050236, entitled "A METHOD PERFORMED BY A CONTROL DEVICE FOR CONTROLLING THE FEEDING DISTANCE AND FEEDING RATE IN A ROCK DRILLING UNIT, A ROCK DRILLING UNIT AND A ROCK DRILLING RIG", filed on Mar. 17, 2021, which claims priority to Swedish Patent Application No. 2050340-5, filed on Mar. 27, 2020, the disclosures and contents of which are hereby incorporated by reference in their entireties.

TECHNICAL FIELD

The present disclosure relates to a method performed by a control device for controlling the feeding distance and feeding rate in a rock drilling unit, a rock drilling unit and a rock drilling rig. The present disclosure further relates to computer program and a computer-readable medium.

BACKGROUND ART

When performing drilling operations in rock-type materials generally special kinds of drilling rigs are used. There are different types of drilling rigs, wherein "DTH" (down the hole)-drilling rigs and top hammer drilling rigs are two commonly used rigs for drilling operations. The drilling rig may comprise a rock drilling unit. A feeding device may be arranged on the drilling unit. The feeding device may be configured for feeding a drill rod with a drill bit in an axial direction. As rock drilling is performed in hard materials special kinds of drill bits are used for such operations. The drill bits will however require maintenance in the form of replacement and/or re-grinding, which in turn leads to a need to remove and attach such drill bits to the drilling rig every now and then. For this reason, the feeding device may be configured for feeding the drill rod with and the drill bit in a forward and backward axial direction.

The rock drilling unit may be provided with a rod handling system, comprising a magazine of drill rods. The drill rods may be brought from the magazine by gripping elements during the boring operation for assembling a bore string with drill rods and thus make it possible to bore deeper into the rock. When changing drill bit, the drill rods are disassembled from each other and successively are brought back to the magazine by the gripping elements.

The feeding device may thus be configured for feeding the drill rod and the drill bit in an axial direction, both during the drilling operation and also during assembling of the bore string and changing of a drill bit. The feeding device may be axially driven in relation to the rock drilling unit and in the direction of the drill centre axis by means of a hydraulic or pneumatic actuator.

A distance sensor may be arranged in the hydraulic or pneumatic actuator for measuring the feeding distance of the drill rod and the drill bit in an axial direction. By means of the distance sensor the depth of the drill hole may be determined.

When the feeding device has reached one of its axial end positions, the actuator stops the axial movement of the feeding device.

SUMMARY OF THE INVENTION

Due to the above described properties and circumstances surrounding drilling operations in rock-type materials and handling of drill bits, the distance measuring arrangements used in rock drilling units are sensitive for aggressive environment connected to the performance of drilling operations in rock-type materials. In addition, the distance measuring arrangements used in rock drilling units are expensive to manufacture and also complicated to protect from the aggressive environment connected to the performance of drilling operations in rock-type materials. In addition to the feeding distance measuring, it would also be convenient to measure the axial feeding rate of the feeding device during drilling the bore. An optimal axial feeding rate of the feeding device, and thus also the drill bit in the axial direction will increase the bore hole quality and also save the drill bit from excessive load. In addition, depending on the configuration of the a rock drilling rig and the a rock drilling unit it would be convenient to arrange a distance and rate measurement device at a position, which has a low exposure for the aggressive environment.

There is thus a need for an improved method for measuring the feeding distance and feeding rate in a rock drilling unit. There is also a need to develop an improved control device configured to perform measurement of the feeding distance and feeding rate in a rock drilling unit. There is also a need to develop a rock drilling unit comprising such a control device, a rock drilling rig comprising such a rock drilling unit, a computer program and a computer-readable medium for executing the method. There is also a need to develop a rock drilling unit and a rock drilling rig, which may be autonomously controlled.

An object of the invention is thus to provide an improved method for measuring the feeding distance and feeding rate in a rock drilling unit. Additional objects are respectively to develop a rock drilling unit, a rock drilling rig comprising such a rock drilling unit, a computer program and a computer-readable medium for executing the method. A further object is to develop a rock drilling unit and a rock drilling rig, which may be autonomously controlled.

These objects are achieved by a method performed by a control device for controlling the feeding distance and feeding rate in a rock drilling unit, a rock drilling unit and a rock drilling rig. These objects are also achieved by a computer program and a computer-readable medium according to the appended claims.

According to an aspect of the invention, a method performed by a control device for controlling the feeding distance and feeding rate in a rock drilling unit is provided, the rock drilling unit comprising: a feeding device for feeding at least one drill rod and a drill bit in an axial direction; a rotating device, which is configured to generate a rotational movement of the at least one drill rod and the drill bit; and a distance and rate measuring device comprising at least one rotational target wheel configured to be driven by the feeding device and at least one sensor device connected to the control device, which sensor device is configured to sensing the rotating motion of the at least one rotational target wheel; the method comprising: controlling the feeding device to move in the axial direction; determining the feeding distance from a first position and the feeding rate of the feeding device from the rotational motion of the at least one rotational target wheel; and controlling the feeding device depending on the determined feeding distance and feeding rate of the feeding device.

This has the advantage that the control device may control the feeding distance and feeding rate of the feeding device based on the determined feeding distance and feeding rate of the feeding device. The instructions from the control device may be based on information received from the at least one sensor device connected to the control device. The control device may be configured to initiate the movement in the axial direction of the feeding device. The axial movement of the feeding device will generate a rotational motion of the at least one rotational target wheel. The sensor device senses the rotating motion of the at least one rotational target wheel. The sensor device also senses if the at least one rotational target wheel rotates or stands still. If there is no rotational motion of the rotational target wheel, there is no axial motion of the feeding device. The feeding distance from a first position and the feeding rate of the feeding device is determined from the rotational motion of the at least one rotational target wheel. The first position of the feeding device may be a predetermined position, a position wherein the drill bit resting on the surface of a rock to be drilled and/or a position, which depends on a specific drilling operation. The method also provides for a flexibility of arranging the rotational target wheel at different positions on the rock drilling rig and/or the rock drilling unit, which positions have low exposure for the aggressive environment. The controlling of the feeding distance and feeding rate of the feeding device may be initiated automatically during a drilling operation, an addition of drilling rods to the drill string and/or at a drill bit changing operation. The controlling of the feeding distance and feeding rate of the feeding device may also be initiated automatically during any other operation related to the rock drilling rig and/or the rock drilling unit, such as an maintenance operation.

According to an aspect of the invention, a computer program comprising instructions which, when the program is executed by a computer, cause the computer to carry out the method. A computer-readable medium comprising instructions, which when executed by a computer, cause the computer to carry out the method. This has the advantage that the method may be comprised in pre-programmed software, which may be implemented into the drilling unit suitable for utilizing the method.

According to an aspect of the invention, a rock drilling unit is provided. The rock drilling unit comprises: a control device; a feeding device for feeding at least one drill rod and a drill bit in an axial direction; a rotating device, which is configured to generate a rotational movement of the at least one drill rod and the drill bit; and a distance and rate measuring device comprising at least one rotational target wheel configured to be driven by the feeding device and at least one sensor device connected to the control device, which sensor device is configured to sensing the rotating motion of the at least one rotational target wheel, wherein the control device being configured to: control the feeding device to move in the axial direction; determine the feeding distance from a first position and the feeding rate of the feeding device from the rotational motion of the at least one rotational target wheel; and control the feeding device depending on the determined feeding distance and feeding rate of the feeding device.

This has the advantage that the control device of the rock drilling unit may control the feeding distance and feeding rate of the feeding device based on the determined feeding distance and feeding rate of the feeding device. The instructions from the control device of the rock drilling unit may be based on information received from the at least one sensor device connected to the control device. In addition, the instructions from the control device may be based on experience data from earlier drilling operations. The control device may be configured to initiate the movement in the axial direction of the feeding device. The movement in the axial direction of the feeding device may be completely handled by means of instructions from the control device. The axial movement of the feeding device will generate a rotational motion of the at least one rotational target wheel. The sensor device senses the rotating motion of the at least one rotational target wheel. The sensor device also senses if the at least one rotational target wheel rotates or stands still. If there is no rotational motion of the rotational target wheel, there is no axial motion of the feeding device. The feeding distance from a first position and the feeding rate of the feeding device is determined from the rotational motion of the at least one rotational target wheel. The first position of the feeding device may be a predetermined position, a position wherein the drill bit resting on the surface of a rock to be drilled and/or a position, which depends on a specific drilling operation. The rotational target wheel may be arranged at different positions on the rock drilling rig and/or the rock drilling unit, which positions have low exposure for the aggressive environment. The control device may be configured to control the feeding distance and feeding rate of the feeding device automatically during a drilling operation, an addition of drilling rods to the drill string and/or at a drill bit changing operation. The control device may also be configured to control the feeding distance and feeding rate of the feeding device automatically during any other operation related to the rock drilling rig and/or the rock drilling unit, such as an maintenance operation.

According to an aspect of the invention, a rock drilling rig is provided, which rock drilling rig comprises the rock drilling unit disclosed herein. Different types of drilling rigs may be used depending on demands for typical rock drilling. The rock drilling rig may be configured for vertical drilling or drilling in an angled direction. The rock drilling rig may be a top hammer drilling rig or a "DTH" (down the hole)-drilling rig, or any other drilling rig suitable for rock drilling.

Further objects, advantages and novel features of the present invention will become apparent to one skilled in the art from the following details, and also by putting the invention into practice. Whereas examples of the invention are described below, it should be noted that it is not restricted to the specific details described. Specialists having access to the teachings herein will recognise further applications, modifications and incorporations within other fields, which are within the scope of the invention.

BRIEF DESCRIPTION OF THE DRAWINGS

For fuller understanding of the present disclosure and further objects and advantages of it, the detailed description set out below should be read together with the accompanying drawings, in which the same reference notations denote similar items in the various figures, and in which.

DETAILED DESCRIPTION

Figure 1:
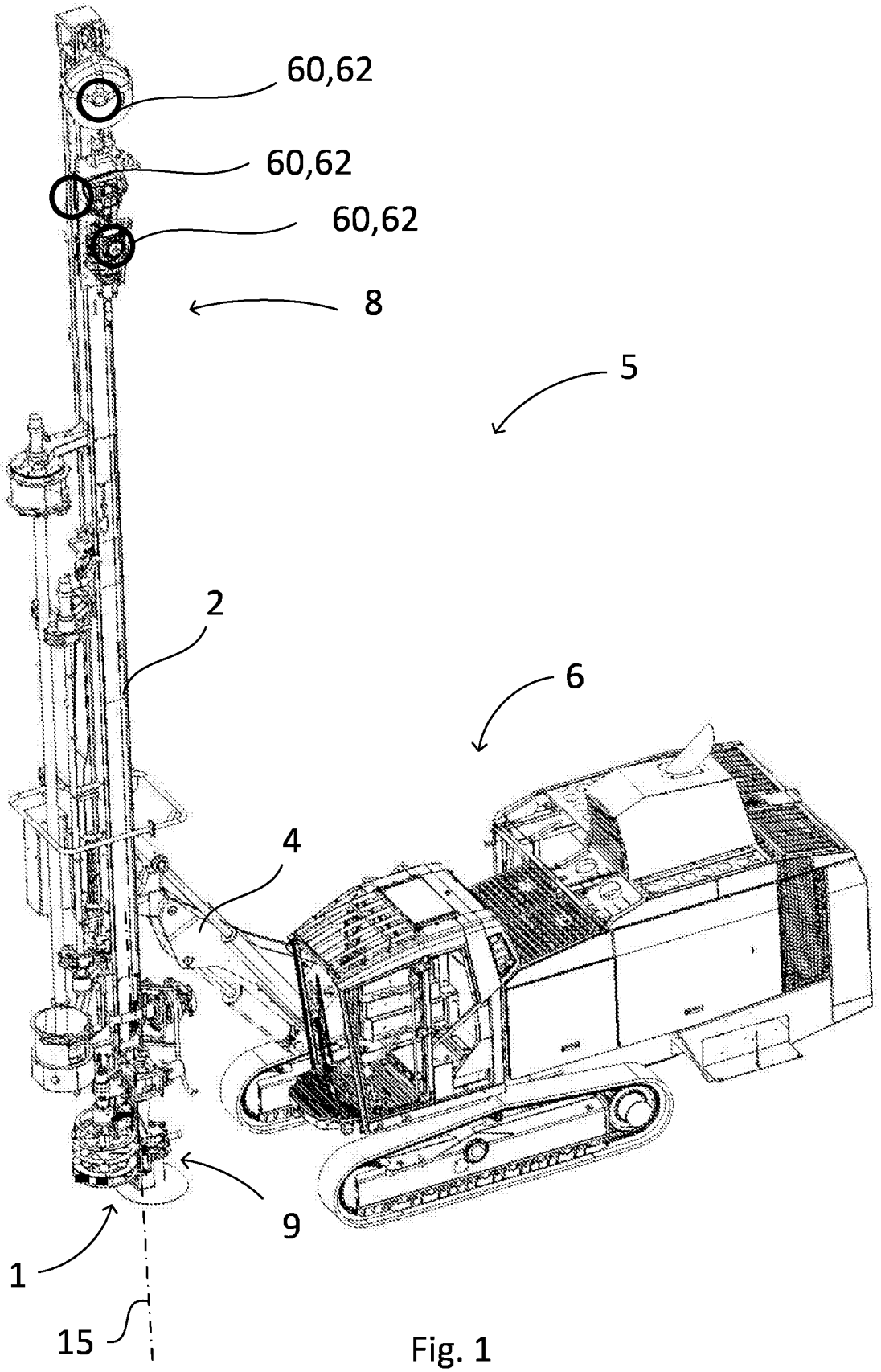
FIG. 1 illustrates a view in perspective of a rock drilling rig according to an example.

The detailed description with reference to the examples depicted are to be viewed as examples comprising a combination of certain features, which features have been described in detail above. It is thus to be understood that additional examples may be achieved by combining other features into examples not depicted herein. The figures are to be viewed as examples and not mutually exclusive combinations. It should also be noted that all figures shown and described are schematically represented, wherein generic parts of machinery or similar is not depicted for the sake of simplicity.

According to an aspect of the present disclosure, a method performed by a control device for controlling the feeding distance and feeding rate in a rock drilling unit is provided, the rock drilling unit comprising: a feeding device for feeding at least one drill rod and a drill bit in an axial direction; a rotating device, which is configured to generate a rotational movement of the at least one drill rod and the drill bit; and a distance and rate measuring device comprising at least one rotational target wheel configured to be driven by the feeding device and at least one sensor device connected to the control device, which sensor device is configured to sensing the rotating motion of the at least one rotational target wheel; the method comprising: controlling the feeding device to move in the axial direction; determining the feeding distance from a first position and the feeding rate of the feeding device from the rotational motion of the at least one rotational target wheel; and controlling the feeding device depending on the determined feeding distance and feeding rate of the feeding device.

The control device may be arranged on the rock drilling unit or at a distance to the rock drilling unit. The control device connected to the sensor device and also to other sensors, which are arranged on the rock drilling unit or at components connected to the rock drilling unit. The sensor device may be configured to sense the rotating motion of the at least one rotational target wheel. However, other sensors may detect activities or characteristics of the rock drilling unit or of the components connected to the rock drilling unit. The control device may comprise a memory in which experience data may be stored.

The drill bit is adapted for rock drilling in hard materials. The drill bit may be designed and provided with a shape adapted to the boring operation to be performed. The drill bit may be provided with a thread, which is adapted to be connected to a corresponding thread on the drill rod to form a first threaded connection.

The rock drilling unit may comprise an elongated frame or beam, on which the first feeding device and the rotating device are arranged. The rock drilling unit may be arranged on and connected to a vehicle by means of a boom, so that the rock drilling unit can be arranged in different positions in relation to the vehicle and to the rock to be drilled. Together, the rock drilling unit, the boom and the vehicle form a rock drilling rig. The drilling unit may be configured for vertical drilling, or in a direction deviating from the vertical direction. The drilling unit may thus be able to be tilted and drill at an angled direction relative a vertical line.

The feeding device is configured for feeding the drill rod and the drill bit in an axial direction, both during the drilling operation and also during changing of a drill bit. The feeding device may be axially driven in relation to the rock drilling unit and in the direction of the drill centre axis by means of a hydraulic or pneumatic actuator.

The rotating device, which is configured to generate a rotational movement of the drill rod and the drill bit may be driven by a first hydraulic or pneumatic machine. The rock drill unit may also be provided with an impact device for providing impact pulses on the at least one drill rod and the drill bit may be driven by a second hydraulic or pneumatic machine. The impact pulses will thus be provided on the drill rod in the direction of the drill centre axis and the impact pulses are transferred from the drill rod to the drill bit.

The distance and rate measuring device comprises at least one rotational target wheel configured to be driven by the feeding device. The distance and rate measuring device also comprises at least one sensor device connected to the control device. The sensor device is configured to sense the rotating motion of the at least one rotational target wheel. The sensor device may be arranged in close proximity to the rotational target wheel. The sensor device will generate a large number of electronic, magnetic or light pulses for each revolution of the rotational target wheel. In addition, a second rotational target wheel may be configured to be driven by the feeding device. The sensor device or a second sensor device may be configured to sense the rotating motion of the second rotational target wheel. Arranging two sensors sensor devices and two rotational target wheel provides two advantages. First, the direction in which the two rotational target wheel are rotating in will be known by which sensor device is triggered first. Second, a pulse will be generated by each sensor device, thereby doubling the number of pulses, which increases the accuracy of the measured distance and rate.

By the method step of controlling the feeding device to move in the axial direction, the control device may receive information from a memory in which operational data are stored. Alternatively or in combination, the control device may receive information from a device, which provides operational data. The operational data may be data comprising any one or a combination of a specific drilling operation, an addition of drilling rods to a drill string and/or at a drill bit changing operation. The control device may initiate controlling the feeding device to move in the axial direction automatically. The operational data may also be data comprising any one or a combination of: time spent drilling, time spent drilling since last maintenance, expected time left until change is needed, meters drilled, meters drilled since last maintenance, or other.

By the method step determining the feeding distance from a first position and the feeding rate of the feeding device from the rotational motion of the at least one rotational target wheel, the control device communicates with the sensor device and receives signals for determining the feeding distance and feeding rate.

By the method step controlling the feeding device depending on the determined feeding distance and feeding rate of the feeding device, the control device communicates with the feeding device and sends signals for controlling the feeding device. The feeding rate and feeding distance of the feeding device may be controlled depending on the determined feeding distance and feeding rate of the feeding device at the specific drilling operation, at the addition of drilling rods to a drill string and/or at the drill bit changing operation, or a combination of these. Other parameters, such as the length of the drill string and/or also on the depth of the drilled bore in the rock may be considered. The feeding rate and feeding distance of the feeding device may also be controlled depending on the type of drill bit.

Even though the feeding device is controlled to move in the axial direction in a first method step, the movement of the feeding device may result in a feeding distance and feeding rate, which deviate from the determined feeding distance and feeding rate in the next method step. Feedback of this deviation may be communicated to the control device, which results in the third method step of controlling the feeding device depending on the determined feeding distance and feeding rate of the feeding device.

Thus, the control device may be configured to initiate the movement in the axial direction of the feeding device. The axial movement of the feeding device will generate a rotational motion of the at least one rotational target wheel. The sensor device senses the rotating motion of the at least one rotational target wheel. The sensor device also senses if the at least one rotational target wheel rotates or stands still. If there is no rotational motion of the rotational target wheel, there is no axial motion of the feeding device. The feeding distance from a first position and the feeding rate of the feeding device is determined from the rotational motion of the at least one rotational target wheel. The first position of the feeding device may be a predetermined position, a position wherein the drill bit resting on the surface of a rock to be drilled and/or a position, which depends on a specific drilling operation. The method also provides for a flexibility of arranging the rotational target wheel at different positions on the rock drilling rig and/or the rock drilling unit, which positions have low exposure for the aggressive environment. The controlling of the feeding distance and feeding rate of the feeding device may be initiated automatically during a drilling operation, an addition of drilling rods to the drill string and/or at a drill bit changing operation. The controlling of the feeding distance and feeding rate of the feeding device may also be initiated automatically during any other operation related to the rock drilling rig and/or the rock drilling unit, such as an maintenance operation.

According to an aspect, the method comprises the further step of: determining the axial feeding direction of the feeding device based on the rotational direction of the at least one rotational target wheel.

In this method step, the sensor device of the distance and rate measuring device communicates with the control device and provides the control device with information about the rotational direction of the rotational target wheel. The axial movement of the feeding device will generate a rotational motion of the at least one rotational target wheel. The sensor device senses the rotating motion of the at least one rotational target wheel. In a first axial feeding direction of the feeding device the rotational target wheel will rotate in a first rotational direction. In a second axial feeding direction of the feeding device, opposite to the first axial feeding direction of the feeding device, the rotational target wheel will rotate in a second rotational direction, which is opposite to the first rotational direction.

According to an aspect, determining the feeding distance and feeding rate of the feeding device from the rotational motion of the at least one rotational target wheel comprises receiving at least one signal from the at least one sensor device.

In this method step, the sensor device of the distance and rate measuring device communicates with the control device and provides the control device with at least one signal. The sensor device is configured to sense the rotating motion of the at least one rotational target wheel. The sensor device may be arranged in close proximity to the rotational target wheel. The sensor device will generate a large number of electronic, magnetic and/or light pulses for each revolution of the rotational target wheel. The electronic, magnetic and/or light pulses generated by the sensor device are signals communicated to the control device. The at least one signal generated by the sensor device may correspond to the feeding distance and feeding rate of the feeding device. In addition, the at least one signal generated by the sensor device may correspond to the axial feeding direction of the feeding device.

According to an aspect, the method comprises the further steps of: resetting the feeding distance from the first position to zero at a predetermined position of the feeding device; and determining the feeding distance of the feeding device from the predetermined position of the feeding device from the rotational motion of the at least one rotational target wheel.

By this method step, the control device may receive information from the sensor device, at the feeding device is at a predetermined position. The predetermined position may be a position on the drilling unit, where the drill bit is resting on the surface of a rock to be drilled and/or a position, which depends on a specific drilling operation. At the predetermined position of the feeding device, the feeding distance from the first position is resetted to zero. The feeding distance may be determined from the predetermined position to a position at a distance from the predetermined position.

According to further steps, the method may comprise: determining a first and second end position for the feeding device; and controlling the feeding device to stop at the first and second end positions. The method may also comprise: adding a number of determined feeding distances to each other in order to achieve a total feeding distance.

The present disclosure also relates to a computer program comprising instructions which, when the program is executed by a computer, causes the computer to carry out the method disclosed above. The invention further relates to a computer-readable medium comprising instructions, which when executed by a computer causes the computer to carry out the method disclosed above. The method may be comprised in pre-programmed software, which may be implemented into the drilling unit suitable for utilizing the method. The pre-programmed software may be stored in the control device. Alternatively, or in combination, the software may be stored in a memory or in computer at a distance from the control device.

Furthermore, the present disclosure relates to a rock drilling unit, the rock drilling unit comprises: a control device; a feeding device for feeding at least one drill rod and a drill bit in an axial direction; a rotating device, which is configured to generate a rotational movement of the at least one drill rod and the drill bit; and a distance and rate measuring device comprising at least one rotational target wheel configured to be driven by the feeding device and at least one sensor device connected to the control device, which sensor device is configured to sensing the rotating motion of the at least one rotational target wheel, wherein the control device being configured to: control the feeding device to move in the axial direction; determine the feeding distance from a first position and the feeding rate of the feeding device from the rotational motion of the at least one rotational target wheel; and control the feeding device depending on the determined feeding distance and feeding rate of the feeding device.

The control device of the rock drilling unit may control the feeding distance and feeding rate of the feeding device based on the determined feeding distance and feeding rate of the feeding device. The instructions from the control device of the rock drilling unit may be based on information received from the at least one sensor device connected to the control device. In addition, the instructions from the control device may be based on experience data from earlier drilling operations. The control device may be configured to initiate the movement in the axial direction of the feeding device. The movement in the axial direction of the feeding device may be completely handled by means of instructions from the control device. The axial movement of the feeding device will generate a rotational motion of the at least one rotational target wheel. The sensor device senses the rotating motion of the at least one rotational target wheel. The sensor device also senses if the at least one rotational target wheel rotates or stands still. If there is no rotational motion of the rotational target wheel, there is no axial motion of the feeding device. The feeding distance from a first position and the feeding rate of the feeding device is determined from the rotational motion of the at least one rotational target wheel. The first position of the feeding device may be a predetermined position, a position wherein the drill bit resting on the surface of a rock to be drilled and/or a position, which depends on a specific drilling operation. The rotational target wheel may be arranged at different positions on the rock drilling rig and/or the rock drilling unit, which positions have low exposure for the aggressive environment. The control device may be configured to control the feeding distance and feeding rate of the feeding device automatically during a drilling operation, an addition of drilling rods to the drill string and/or at a drill bit changing operation. The control device may also be configured to control the feeding distance and feeding rate of the feeding device automatically during any other operation related to the rock drilling rig and/or the rock drilling unit, such as an maintenance operation.

It will be appreciated that all the examples described for the method aspect of the disclosure performed by the control device are also applicable to the rock drilling unit and the control device aspect of the disclosure. That is, the control device of the rock drilling unit may be configured to perform any one of the steps of the method according to the various examples described above. Thus, according to the following aspects, the control device of the rock drilling unit may be configured to perform the method steps according to the corresponding examples described above.

According to an aspect, the control device may thus be configured to determine the axial feeding direction of the feeding device based on the rotational direction of the at least one rotational target wheel. According to an aspect determine the feeding distance and feeding rate of the feeding device from the rotational motion of the at least one rotational target wheel comprises to receive a signal from the at least one sensor device. According to a further aspect, the control device may be configured to reset the feeding distance from the first position to zero at a predetermined position of the feeding device; and determine the feeding distance of the feeding device from the predetermined position of the feeding device from the rotational motion of the at least one rotational target wheel.

According to a further aspect, the at least one rotational target wheel is connected to a hose drum, which hose drum is rotatably driven by the motion of the feeding device. The feeding device may be axially driven in relation to the rock drilling unit and in the direction of the drill centre axis by means of a hydraulic or pneumatic actuator. Further, the rotating device, which is configured to generate a rotational movement of the drill rod and the drill bit may be driven by a first hydraulic or pneumatic machine. A possible impact device on the drilling unit for providing impact pulses on the at least one drill rod and the drill bit may be driven by a second hydraulic or pneumatic machine. The actuator and machines may be connected to hydraulic pump or a compressor by hoses arranged on the drilling unit or at a distance from the drilling unit. The hoses may be winded on a hose drum. During the feeding motion of the feeding device, the hoses may be unwinded from the hose drum or winded up on the hose drum depending on the feeding direction of the feeding device. When feeding the feeding device in first direction, which may be a direction from the hose drum, the hoses may be unwinded from the hose drum and the hose drum may rotate in a first rotational direction. When feeding the feeding device in a second direction, which may be a direction towards the hose drum, the hoses may be winded up on the hose drum and the hose drum may rotate in a second rotational direction. The feeding distance and feeding rate of the feeding device may be proportional to the rotational motion of the hose drum. The target wheel will follow the rotational motion and rotational direction of the hose drum. The target wheel may be arranged directly on a rotational axis of the hose drum. Alternatively, the target wheel may be arranged at distance from the hose drum, and connected to the hose drum by a transmission, such as a shaft or a belt. The transmission may have a gear ratio. According to example, if the transmission is connected to the rotational target wheel having a gear ratio of G:1, this means that there would be G×the number of pulses of the rotational target wheel for each rotation of the hose drum, making it possible to control the movement of the feeding device very accurately. Since the rotational motion of the hose drum is generated by the feeding device, the distance and rate measuring device comprising the at least one rotational target wheel may be configured to be driven by the feeding device.

According to a further aspect, the at least one rotational target wheel is connected to a drive shaft of a hydraulic motor, which hydraulic motor is configured to drive the feeding device. The feeding device may be axially driven in relation to the rock drilling unit and in the direction of the drill centre axis by means of a hydraulic motor. During the feeding motion of the feeding device, a drive shaft of the hydraulic motor will rotate in a first or second direction depending on the feeding direction of the feeding device. When feeding the feeding device in a first direction, the drive shaft of the hydraulic motor may rotate in a first rotational direction. When feeding the feeding device in a second direction, the drive shaft of the hydraulic motor may rotate in a second rotational direction. The feeding distance and feeding rate of the feeding device may be proportional to the rotational motion of the hose drum. The target wheel will follow the rotational motion and rotational direction of the drive shaft of the hydraulic motor. The target wheel may be arranged directly on drive shaft of the hydraulic motor. Alternatively, the target wheel may be arranged at distance from the hydraulic motor, and connected to the drive shaft of the hydraulic motor by a transmission, such as a shaft or a belt. The transmission may have a gear ratio. According to example, if the transmission is connected to the rotational target wheel having a gear ratio of G:1, this means that there would be G×the number of pulses of the rotational target wheel for each rotation of the drive shaft of the hydraulic motor, making it possible to control the movement of the feeding device very accurately. Since the rotational motion of the drive shaft of the hydraulic motor generates a motion of the feeding device, and the feeding device comprises the hydraulic motor, the distance and rate measuring device comprising the at least one rotational target wheel may be configured to be driven by the feeding device.

According to a further aspect, the at least one rotational target wheel is connected to an elongated frame or beam of the rock drilling unit or on the feeding device, which the at least one rotational target wheel is configured to be driven by the motion of the feeding device in relation to the elongated frame or beam. The feeding device may be axially driven in relation to an elongated frame or beam of the rock drilling unit and in the direction of the drill centre axis by means of an actuator, such as a hydraulic motor. During the feeding motion of the feeding device, a relative motion between the feeding device and the elongated frame or beam of the rock drilling unit will occur. The at least one rotational target wheel is driven by the relative motion between the feeding device and the elongated frame or beam of the rock drilling unit. The axial motion of the feeding device may be transferred to the at least one rotational target wheel by a transmission, such as a friction wheel which is rotatably arranged on the feeding device and resting at its periphery on the elongated frame or beam of the rock drilling unit. The rotational motion of the friction wheel may be transmitted from the friction wheel to the at least one rotational target wheel by a transmission, such as a shaft or a gearbox. Alternatively, the at least one rotational target wheel may be provided with a peripheral friction surface resting directly on the elongated frame or beam of the rock drilling unit. The feeding device may move in a first or second axial direction in relation to the elongated frame or beam of the rock drilling unit. When feeding the feeding device in an axial first direction, the at least one rotational target wheel may rotate in first rotational direction. When feeding the feeding device in an axial second direction, the at least one rotational target wheel may rotate in a second rotational direction. The feeding distance and feeding rate of the feeding device may be proportional to the rotational motion of the at least one rotational target wheel. The transmission connected to the at least one rotational target wheel may have a gear ratio. According to example, if the transmission is connected to the rotational target wheel having a gear ratio of G:1, this means that there would be G×the number of pulses of the rotational target wheel for each rotation of the drive shaft of the hydraulic motor, making it possible to control the movement of the feeding device very accurately. Since the rotational motion of the at least one rotational target wheel is generated by the motion of the feeding device, the distance and rate measuring device comprising the at least one rotational target wheel may be configured to be driven by the feeding device.

Furthermore, the present disclosure relates to a rock drilling rig comprising the rock drilling unit as disclosed herein. The rock drilling rig comprises the rock drilling unit as disclosed herein. In addition the rock drilling rig may also comprise a drilling platform, such as a vehicle. Connecting the rock drilling unit to a vehicle results in the rock drilling rig may easily be moved to different places and to different positions between drilling operations. The rock drilling unit may be arranged on and connected to a vehicle by means of a boom, so that the rock drilling unit can be arranged in different positions in relation to the vehicle and to the rock to be drilled. The rock drilling rig may be configured for vertical drilling or in an angled direction, relative a vertical line.

The drilling rig may comprise an interchangeable plurality of drill rods, wherein drill bits may be arranged at an end section of an end drill rod. The drill bit may be attached to the end section by means of a threaded connection. The rock drilling rig is configured for vertical drilling. However, the rock drilling rig may also be configured for drilling in a direction which deviates from vertical drilling. The drilling rig may be a top hammer drilling rig. This has the advantage that a commonly used drilling rig may be provided having a drill bit changer for at least semi-automatic changing of drill bits. The commonly used top hammer drilling rig may be provided with a reliable and safe system for changing the drill bits of said drilling rig. An efficient and reliable drilling rig is thus provided, which by means of the system arranged thereto provides a safe and convenient work environment due to not having the need to change drill bits manually.

The present invention will now be further illustrated with reference to the appended figures.

FIG. 1 shows a rock drilling rig 5 in a view of perspective according to an example. The rock drilling rig 5 comprises a rock drilling unit 8, which may comprise an elongated frame or beam 2. The rock drilling unit 8 may be arranged on and connected to a vehicle 6 by means of a boom 4, so that the rock drilling unit 8 can be arranged in different positions in relation to the vehicle 6 and to the rock to be drilled. Together, the rock drilling unit 8, the boom 4 and the vehicle 6 form the rock drilling rig 5. The drilling rig 5 is configured for vertical drilling, which is to be perceived as completely vertical or deviating from vertical to some extent. The drilling rig 5 may comprise an interchangeable plurality of drill rods 7 (FIG. 2), arranged to form a drill string within a rock drilling unit 8 of the drilling rig 5. Each drill rod 7 comprises threads providing the option of connecting additional drill rods 7 as a drill bore 50 (FIG. 2) being drilled gets deeper. A drill bit 3 is then arranged at an end section of an end drill rod 7, wherein said drill bit 3 may be attached to the end section by means of a first threaded connection 40.

The rock drilling rig 5 comprises a distance and rate measuring device comprising at least one rotational target wheel, which may be arranged at different positions on the rock drilling unit 8. The drilling rig 5 may further comprise a support device 9, such as a lower support device, which may be arranged at a lower portion of the rock drilling unit 8 and being arranged for supporting and/or holding/gripping a drill bit 3 or a drill rod 7, which may be utilized for maintenance and/or assembly/disassembly or such parts. In addition, the support device 9 may guide the drill rod 7. The drilling rig 5 shown in FIG. 1 may further comprise a drill bit changer 1 for automatically or at least semi-automatic changing of drill bits 3. The drilling unit 8 comprises a drill centre axis 15. The term drill centre axis 15 may be perceived as a centre line in a drill bore 50 (FIG. 2) being drilled by means of the drilling rig 5.

Figure 2:
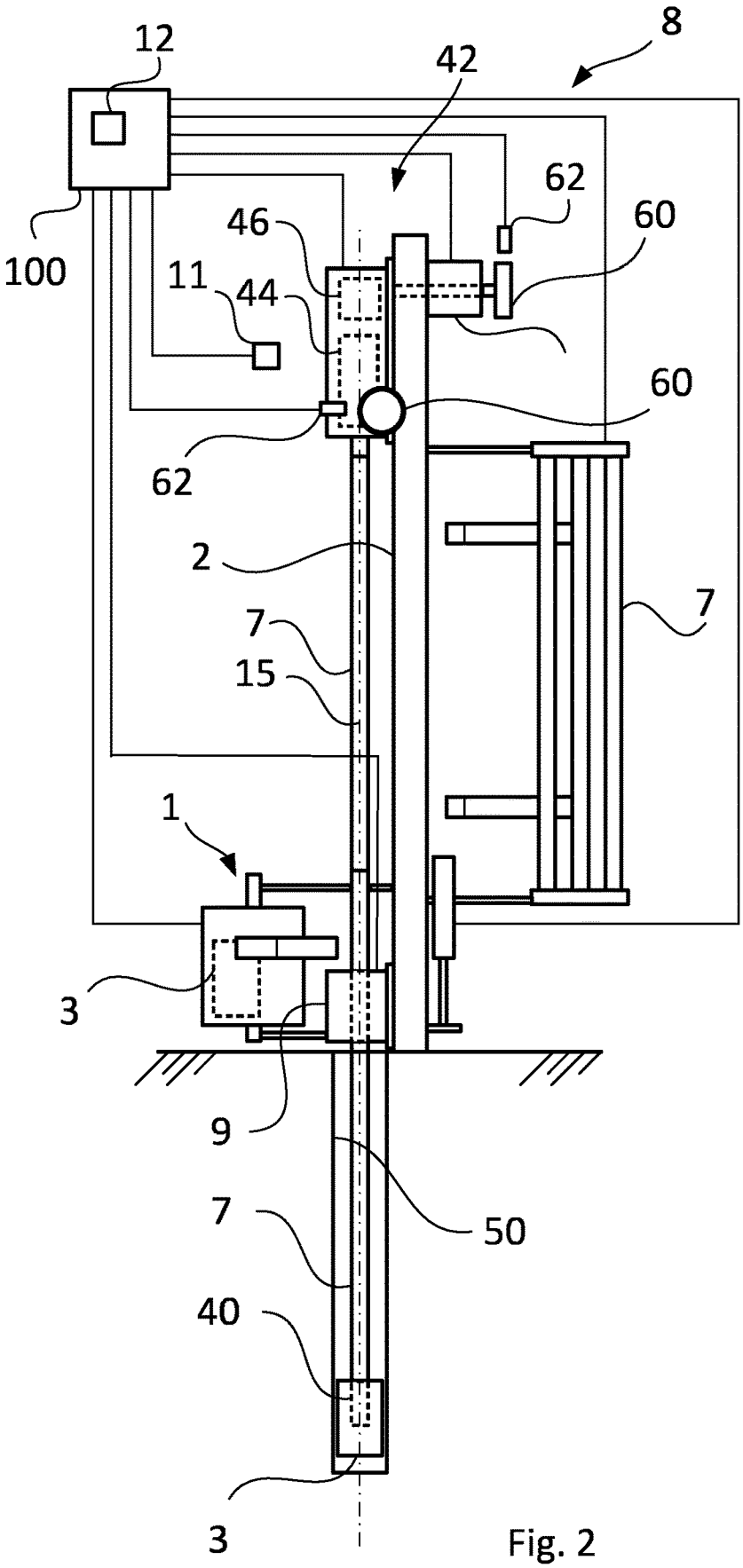
FIG. 2 schematically illustrates a side view of a rock drilling unit according to an example.

FIG. 2 schematically illustrates a side view of a rock drilling unit 8 according to an example. The drill bit 3 is configured to be connected to a drill rod 7 by the first threaded connection 40. The rock drilling unit 8 comprising a feeding device 42, which is configured for feeding the at least one drill rod 7 and the drill bit 3 in an axial direction. A rotating device 44 is configured to generate a rotational movement of the at least one drill rod 7 and the drill bit 3. An impact device 46 may be configured for providing impact pulses on the at least one drill rod 7 and the drill bit 3. Such impact device 46 is not necessary, but may be useful depending on the type of drilling operation. The drill bit changer 1 is arranged on the rock drilling unit 8 for changing drill bits 3 on the drill rod 7. The rotating device 44 and the impact device 44 are arranged on the first feeding device 42. The rotating device 44 and the impact device 44 are configured to be displaced by means of the first feeding device 42. The first feeding device 42 is arranged on elongated frame or beam 2. The first feeding device 42 is configured for feeding the drill rod 7 and the drill bit 3 in an axial direction, both during the drilling operation and also during changing of a drill bit 3. The first feeding device 42 may be axially driven in relation to the rock drilling unit 8 and in the direction of the drill centre axis 15 by means of a hydraulic or pneumatic actuator 10. The hydraulic or pneumatic actuator 10 may be a hydraulic motor 10 provided with a drive shaft 17.

The rotational target wheel 60 of the distance and rate measuring device 60, 62 is arranged on and driven by the feeding device 42. The rotational target wheel 60 is in FIG. 2 connected to the elongated frame or beam 2 of the rock drilling unit 8 or on the feeding device 42. The rotational target wheel 60 is configured to be driven by the motion of the feeding device 42 in relation to the elongated frame or beam 2. The rotational target wheel 60 may also or alternatively, as been disclosed in FIG. 2, be connected to a drive shaft 65 of the hydraulic motor 66, which hydraulic motor 66 is configured to drive the feeding device 42. At least one sensor device 62 is connected to the control device 100, which sensor device 62 is configured to sense the rotating motion of the at least one rotational target wheel 60.

The control device 100 is connected to the feeding device 42, the rotating device 44, the impact device 46 and to the drill bit changer 1. The control device 100 may be connected to sensors 11, which are arranged on the rock drilling unit 8 or at the components connected to the rock drilling unit 8. The control device 100 may receive information from a memory 12 in which operational data are stored.

The control device 100 is configured to control the feeding device 42 to move in the axial direction; to determine the feeding distance from a first position and the feeding rate of the feeding device 42 from the rotational motion of the at least one rotational target wheel 60; and to control the feeding device 42 depending on the determined feeding distance and feeding rate of the feeding device 42. Further the control device 100 being configured to determine the axial feeding direction of the feeding device 42 based on the rotational direction of the at least one rotational target wheel 60. Determine the feeding distance and feeding rate of the feeding device 42 from the rotational motion of the at least one rotational target wheel 60 may comprise to receive at least one signal from the at least one sensor device 62. Further, the control device 100 may also be configured to receive information about changing the drill bit 3 and to control the drill bit changer for changing and replacing the drill bit 3.

Figure 3A:
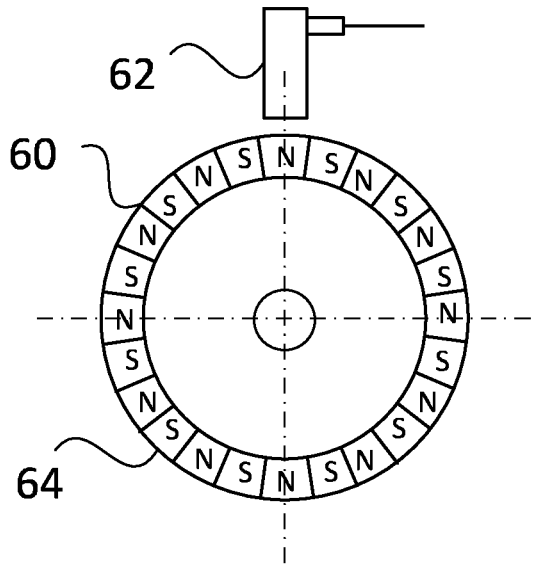
FIGS. 3*a* and 3*b* illustrate side views of distance and rate measuring devices configured to be connected to a rock drilling unit according to different examples.

FIG. 3*a* illustrates a side view of the distance and rate measuring device 60, 62 configured to be connected to the rock drilling unit 8 according to a first example. The sensor device 62 is configured to sense the rotating motion of the rotational target wheel 60. The sensor device 62 may be arranged in close proximity to the rotational target wheel 60. The sensor device 62 will generate a large number of electronic, magnetic or light pulses for each revolution of the rotational target wheel 60. In the example shown in FIG. 3*a* a number of magnets 64 are arranged on the periphery of the rotational target wheel 60.

Figure 3B:
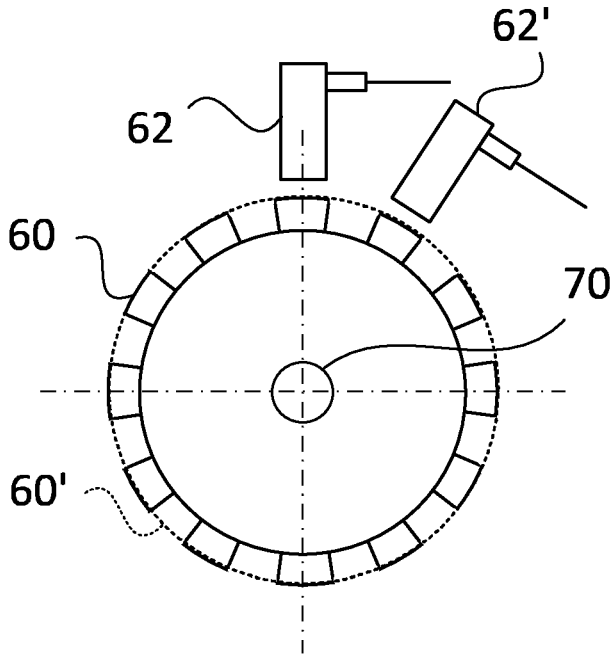

FIG. 3*b* illustrates a side view of the distance and rate measuring device 60, 62 configured to be connected to the rock drilling unit 8 according to a second example. A number of protrusions 66 and recesses 68 similar to a cogwheel are arranged on the periphery of the rotational target wheel 60. Two sensor devices 62, 62' may be arranged in close proximity to the rotational target wheel 60. This will increase accuracy of the measured distance and rate. In addition, the rotational direction of the rotational target wheel 62 may be detected.

In addition, a second rotational target wheel 60' may be configured to be driven by the feeding device 42. The second rotational target wheel 60' may be arranged at the same rotational shaft 70 as the first rotational target wheel 60. The sensor device 62 and/or a second sensor device 62' may be configured to sense the rotating motion of the second rotational target wheel 60'. Arranging two sensor devices 62, 62' and two rotational target wheels 60, 60' provides two advantages. First, the direction in which the two rotational target wheels 60, 60' are rotating in will be known by which sensor device 62, 62' is triggered first. Second, a pulse will be generated by each sensor device 62, 62', thereby doubling the number of pulses, which increases the accuracy of the measured distance and rate.

Figures 4A, 4B, 4C:
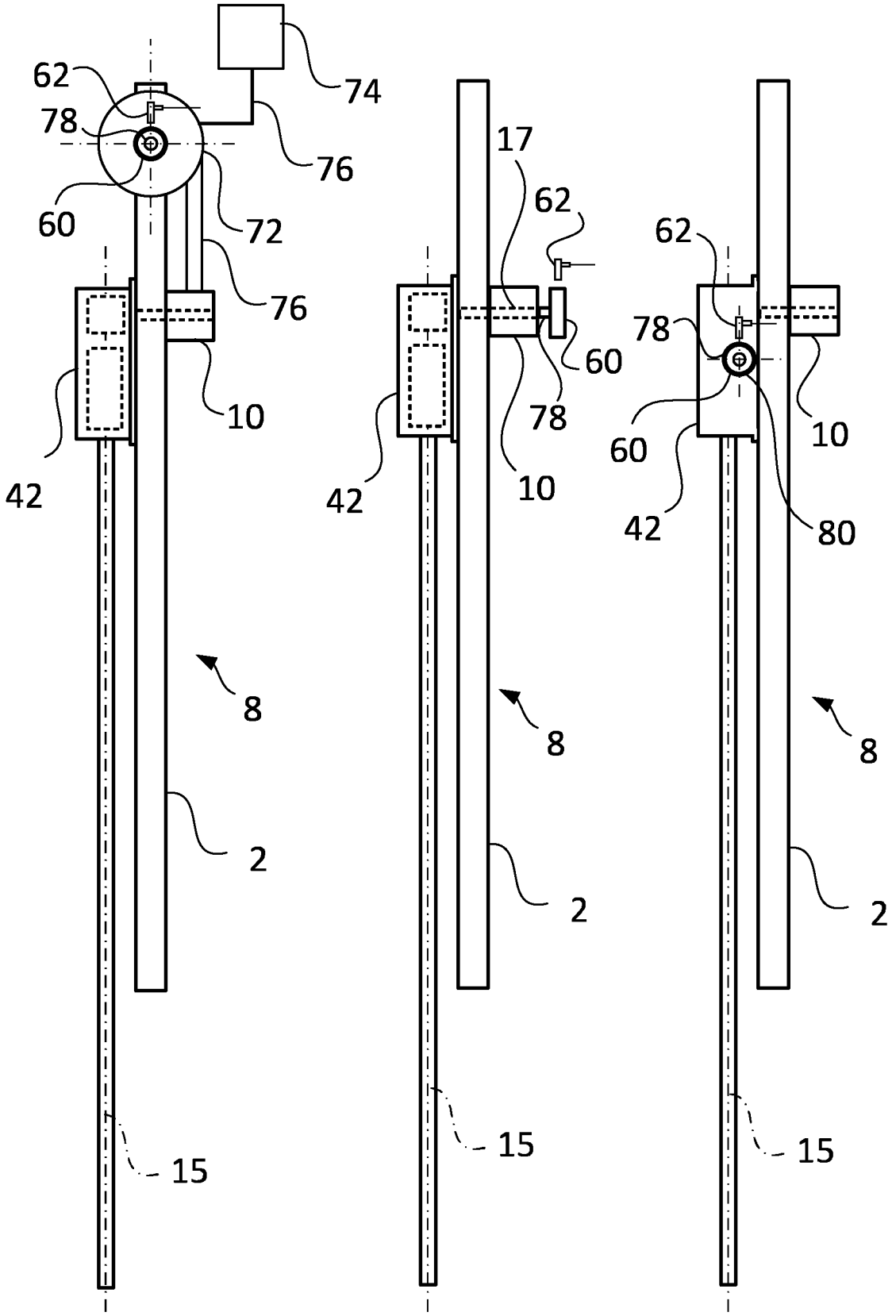
FIGS. 4*a*-4*c* illustrate side views of distance and rate measuring devices configured to be connected to a rock drilling unit according to different examples.

FIG. 4*a* schematically illustrates a side view of distance and rate measuring device 60, 62 configured to be connected to a rock drilling unit 8 according to a first example. The rotational target wheel 60 is connected to a hose drum 72, which hose drum 72 is rotatably driven by the motion of the feeding device 42. The feeding device 42 may be axially driven in relation to the elongated frame or beam 2 of the rock drilling unit 8 and in the direction of the drill centre axis 15 by means of the hydraulic or pneumatic motor 10. The motor 10 may be connected to hydraulic pump 74 or a compressor by hoses 76 arranged on the drilling unit 8 or at a distance from the drilling unit 8. The hoses 76 may be winded on the hose drum 72. During the feeding motion of the feeding device, the hoses 76 may be unwinded from the hose drum 72 or winded up on the hose drum 72 depending on the feeding direction of the feeding device 42. When feeding the feeding device 42 in first direction, which may be a direction from the hose drum 72, the hoses 76 may be unwinded from the hose drum 72 and the hose drum 72 may rotate in a first rotational direction. When feeding the feeding device in a second direction, which may be a direction towards the hose drum 72, the hoses 76 may be winded up on the hose drum 72 and the hose drum 72 may rotate in a second rotational direction. The target wheel 60 will follow the rotational motion and rotational direction of the hose drum 72. The target wheel 60 may be arranged directly on a rotational axis of the hose drum 72. Alternatively, the target wheel 60 may be arranged at distance from the hose drum 72, and connected to the hose drum 72 by a transmission 78, such as a shaft or a belt.

FIG. 4*b* schematically illustrates a side view of distance and rate measuring device 60, 62 configured to be connected to a rock drilling unit 8 according to a second example. The rotational target wheel 60 is connected to a drive shaft 17 of a hydraulic motor 10, which hydraulic motor 10 is configured to drive the feeding device 42. The feeding device 42 may be axially driven in relation to the rock drilling unit 8 and in the direction of the drill centre axis 15 by means of the hydraulic motor 10. The feeding distance and feeding rate of the feeding device 42 may be proportional to the rotational motion of the drive shaft 17. The target wheel 60 will follow the rotational motion and rotational direction of the drive shaft 17 of the hydraulic motor 10. The target wheel 60 may be arranged directly on drive shaft 17 of the hydraulic motor 10. Alternatively, the target wheel 60 may be arranged at distance from the hydraulic motor 10, and connected to the drive shaft 17 of the hydraulic motor 10 by a transmission 78.

FIG. 4*c* schematically illustrates a side view of distance and rate measuring device 60, 62 configured to be connected to a rock drilling unit 8 according to a third example. The rotational target wheel 60 is connected to the elongated frame or beam 2 of the rock drilling unit 8 or on the feeding device 42, which target wheel 60 is configured to be driven by the motion of the feeding device 42 in relation to the elongated frame or beam 2. The feeding device 42 may be axially driven in relation to an elongated frame or beam 2 of the rock drilling unit 8 and in the direction of the drill centre axis 15 by means of an actuator, such as a hydraulic motor 10. During the feeding motion of the feeding device 42, a relative motion between the feeding device 42 and the elongated frame or beam 2 of the rock drilling unit 8 will occur. The at least one rotational target wheel 60 is driven by the relative motion between the feeding device 42 and the elongated frame or beam 2 of the rock drilling unit 8. The axial motion of the feeding device 42 may be transferred to the at least one rotational target wheel 60 by a friction wheel 80 which is rotatably arranged on the feeding device 42 and resting at its periphery on the elongated frame or beam 2 of the rock drilling unit 8. The rotational motion of the friction wheel 80 may be transmitted from the friction wheel 80 to the at least one rotational target wheel 60 by a transmission 78, such as a shaft or a gearbox. Alternatively, the rotational target wheel 60 may be provided with a peripheral friction surface resting directly on the elongated frame or beam 2 of the rock drilling unit 8. The feeding device 42 may move in a first or second axial direction in relation to the elongated frame or beam 2 of the rock drilling unit 42. When feeding the feeding device 42 in an axial first direction, the at least one rotational target wheel 60 may rotate in first rotational direction. When feeding the feeding device 42 in an axial second direction, the at least one rotational target wheel 60 may rotate in a second rotational direction. The feeding distance and feeding rate of the feeding device 42 may be proportional to the rotational motion of the at least one rotational target wheel 60.

Figure 5:
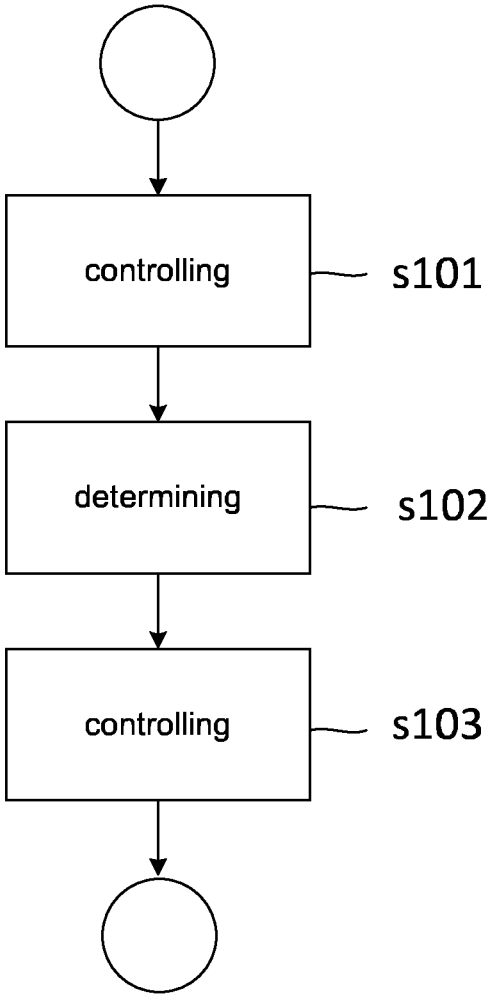
FIG. 5 shows a flowchart of a method according to an example.

FIG. 5 shows a flowchart of a method according to an example. The method is performed by a control device 100, for controlling the feeding distance and feeding rate in a rock drilling unit 8. The method thus relates to the controlling of the feeding distance and feeding rate in a rock drilling unit 8 disclosed in FIGS. 1-4. The rock drilling unit 8 comprising: a feeding device 42 for feeding at least one drill rod 7 and a drill bit 3 in an axial direction; a rotating device 44, which is configured to generate a rotational movement of the at least one drill rod 7 and the drill bit 3; and a distance and rate measuring device 60, 62 comprising at least one rotational target wheel 60 configured to be driven by the feeding device 42 and at least one sensor device 62 connected to the control device 100, which sensor device 62 is configured to sensing the rotating motion of the at least one rotational target wheel 60.

The method comprising: controlling s101 the feeding device 42 to move in the axial direction; determining s102 the feeding distance from a first position and the feeding rate of the feeding device 42 from the rotational motion of the at least one rotational target wheel 60; and controlling s103 the feeding device 42 depending on the determined feeding distance and feeding rate of the feeding device 42.

Figure 6:
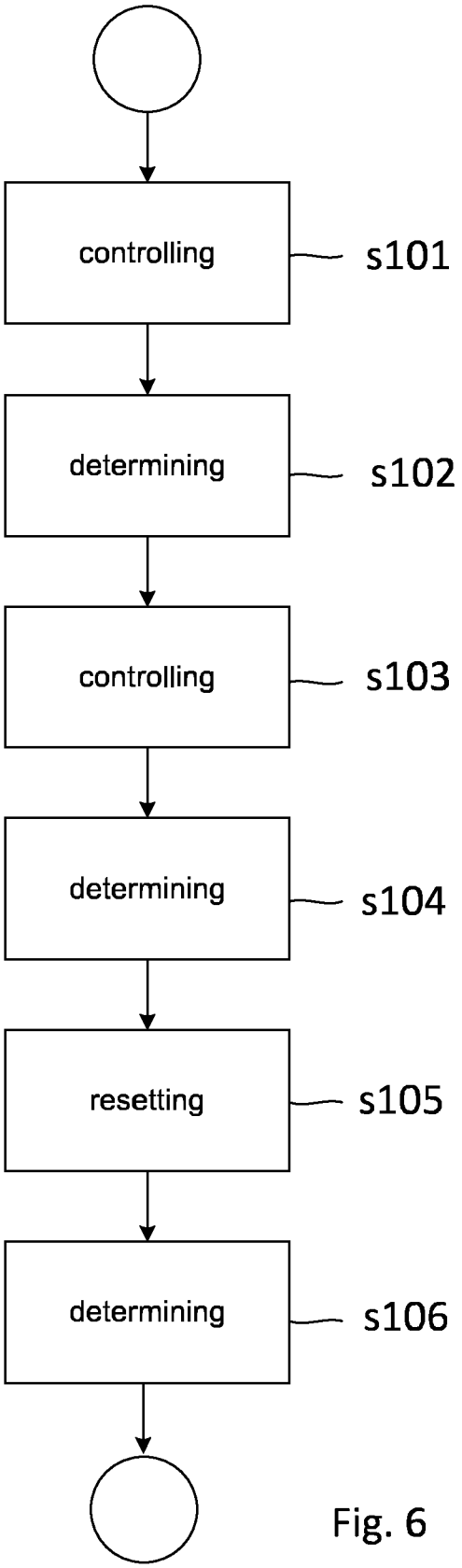
FIG. 6 shows a flowchart of a method according to an example.

FIG. 6 shows a flowchart of a method according to an example. The method is performed by a control device 100, for controlling the feeding distance and feeding rate in a rock drilling unit 8. The method thus relates to the controlling of the feeding distance and feeding rate in a rock drilling unit 8 disclosed in FIGS. 1-4. The method comprising: controlling s101 the feeding device 42 to move in the axial direction; determining s102 the feeding distance from a first position and the feeding rate of the feeding device 42 from the rotational motion of the at least one rotational target wheel 60; and controlling s103 the feeding device 42 depending on the determined feeding distance and feeding rate of the feeding device.

The method comprises the further step of: determining s104 the axial feeding direction of the feeding device 42 based on the rotational direction of the at least one rotational target wheel 60.

Determining s102 the feeding distance and feeding rate of the feeding device 42 from the rotational motion of the at least one rotational target wheel 60 comprises receiving at least one signal from the at least one sensor device 62.

The method comprises the further steps of: resetting s105 the feeding distance from the first position to zero at a predetermined position of the feeding device 42; and determining s106 the feeding distance of the feeding device 42 from the predetermined position of the feeding device 42 from the rotational motion of the at least one rotational target wheel 60.

Figure 7:
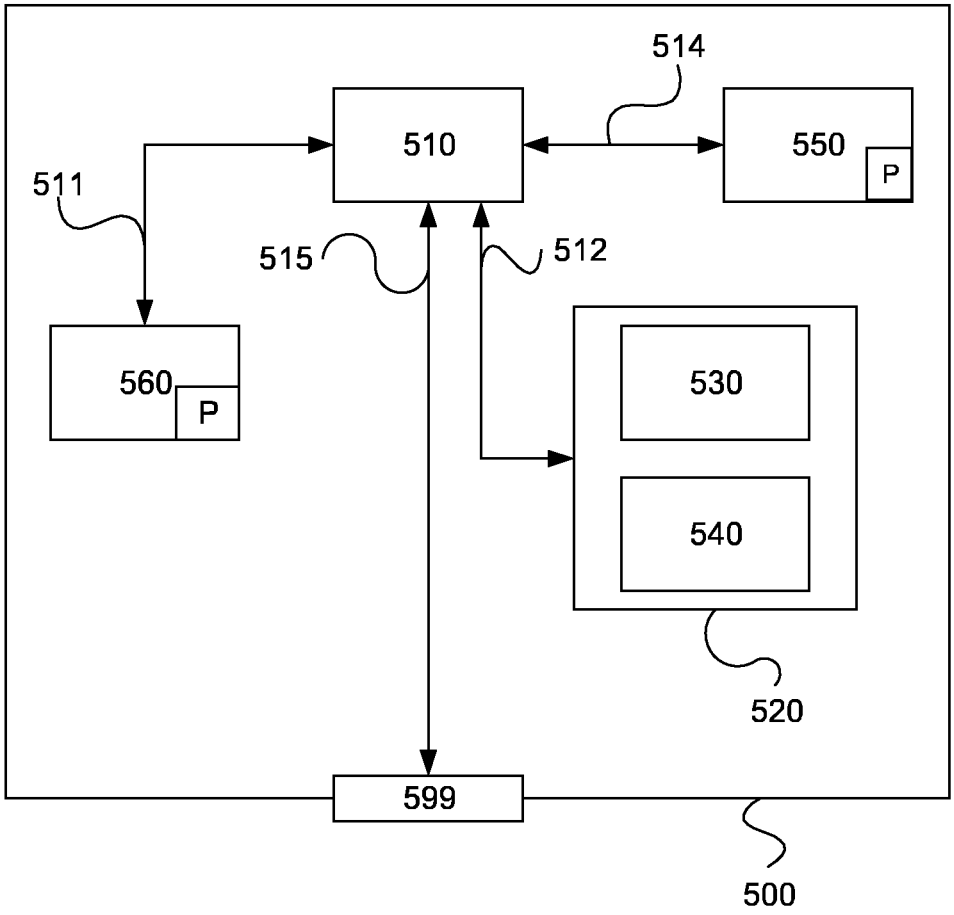
FIG. 7 schematically illustrates a control device or computer according to an example.

FIG. 7 is a diagram of a version of a device 500. The control device 100 described with reference to FIG. 2 and FIG. 3 may in a version comprise the device 500. The device 500 comprises a non-volatile memory 520, a data processing unit 510 and a read/write memory 550. The non-volatile memory 520 has a first memory element 530 in which a computer programme, e.g. an operating system, is stored for controlling the function of the device 500. The device 500 further comprises a bus controller, a serial communication port, I/O means, an A/D converter, a time and date input and transfer unit, an event counter and an interruption controller (not depicted). The non-volatile memory 520 has also a second memory element 540.

There is provided a computer programme P which comprises routines for controlling the rock drilling rig 5. The programme P may be stored in an executable form or in a compressed form in a memory 560 and/or in a read/write memory 550.

Where the data processing unit 510 is described as performing a certain function, it means that the data processing unit 510 effects a certain part of the programme stored in the memory 560 or a certain part of the programme stored in the read/write memory 550.

The data processing device 510 can communicate with a data port 599 via a data bus 515. The non-volatile memory 520 is intended for communication with the data processing unit 510 via a data bus 512. The separate memory 560 is intended to communicate with the data processing unit 510 via a data bus 511. The read/write memory 550 is adapted to communicating with the data processing unit 510 via a data bus 514.

When data are received on the data port 599, they are stored temporarily in the second memory element 540. When input data received have been temporarily stored, the data processing unit 510 is prepared to effect code execution as described above.

Parts of the methods herein described may be effected by the device 500 by means of the data processing unit 510 which runs the programme stored in the memory 560 or the read/write memory 550. When the device 500 runs the programme, methods herein described are executed.

The foregoing description of the embodiments has been furnished for illustrative and descriptive purposes. It is not intended to be exhaustive, or to limit the embodiments to the variations described. Many modifications and variations will obviously be apparent to one skilled in the art. The embodiments have been chosen and described in order to best explicate principles and practical applications, and to thereby enable one skilled in the arts to understand the invention in terms of its various embodiments and with the various modifications that are applicable to its intended use. The components and features specified above may, within the framework of the disclosure, be combined between different embodiments specified.

The invention claimed is:

1. A method performed by a control device for controlling a feeding distance and a feeding rate in a rock drilling unit, the rock drilling unit comprising:

a feeding device for feeding at least one drill rod and a drill bit in an axial direction;

a rotating device configured to generate a rotational movement of the at least one drill rod and the drill bit;

a hose drum rotatably driven by a motion of the feeding device, wherein in an event of feeding the feeding device in first direction, hoses are unwound from the hose drum and the hose drum rotates in a first rotational direction, and wherein in an event of feeding the feeding device in a second direction, the hoses are winded up on the hose drum and the hose drum rotates in a second rotational direction; and a distance and rate measuring device comprising at least one rotational target wheel configured to be driven by the feeding device and at least one sensor device connected to the control device, wherein the at least one sensor device is configured to sense a rotational motion of the at least one rotational target wheel;

wherein the at least one rotational target wheel is connected to the hose drum, the at least one rotational target wheel being arranged directly on a rotational axis of the hose drum, or being arranged at distance from the hose drum and connected to the hose drum by a transmission;

wherein the at least one rotational target wheel is arranged to follow a rotational motion and rotational direction of the hose drum;

the method comprising:

controlling the feeding device to move in the axial direction;

determining the feeding distance from a first position and the feeding rate of the feeding device from the rotational motion of the at least one rotational target wheel;

determining an axial direction of the feeding device based on the rotational motion of the at least one rotational target wheel;

controlling the feeding device based on the determined feeding distance, feeding rate, and axial direction of the feeding device.

2. The method according to claim 1, wherein determining the feeding distance and feeding rate of the feeding device based on the rotational motion of the at least one rotational target wheel comprises receiving at least one signal from the at least one sensor device.

3. The method according to claim 1, the method further comprises:

resetting the feeding distance from the first position to zero at a predetermined position of the feeding device; and determining the feeding distance of the feeding device from the predetermined position of the feeding device from the rotational motion of the at least one rotational target wheel.

4. A non-transitory computer-readable medium comprising instructions, which when executed by a computer, cause the computer to carry out the method according to claim 1.

5. A rock drilling unit comprising:

a control device;

a feeding device for feeding at least one drill rod and a drill bit in an axial direction;

a rotating device, configured to generate a rotational movement of the at least one drill rod and the drill bit; and a hose drum rotatably driven by a motion of the feeding device, wherein in an event of feeding the feeding device in first direction, hoses are unwound from the hose drum and the hose drum rotates in a first rotational direction, and wherein in an event of feeding the feeding device in a second direction, the hoses are winded up on the hose drum and the hose drum rotates in a second rotational direction;

a distance and rate measuring device comprising at least one rotational target wheel configured to be driven by the feeding device and at least one sensor device connected to the control device, wherein the at least one sensor device is configured to sense the rotational motion of the at least one rotational target wheel, wherein the at least one rotational target wheel is connected to the hose drum, the at least one rotational target wheel being arranged directly on a rotational axis of the hose drum, or being arranged at distance from the hose drum and connected to the hose drum by a transmission, wherein the at least one rotational target wheel is arranged to follow a rotational motion and rotational direction of the hose drum, and wherein the control device being configured to:

control the feeding device to move in the axial direction;

determine a feeding distance from a first position and a feeding rate of the feeding device from the rotational motion of the at least one rotational target wheel;

determine an axial direction of the feeding device based on the rotational motion of the at least one rotational target wheel;

control the feeding device depending on the determined feeding distance, feeding rate, and axial direction of the feeding device.

6. The rock drilling unit according to claim 5, wherein determine the feeding distance and feeding rate of the feeding device from the rotational motion of the at least one rotational target wheel comprises to receive at least one signal from the at least one sensor device.

7. The rock drilling unit according to claim 5, wherein the control device being configured to:

reset the feeding distance from the first position to zero at a predetermined position of the feeding device; and determine the feeding distance of the feeding device from the predetermined position of the feeding device from the rotational motion of the at least one rotational target wheel.

8. The rock drilling unit according to claim 5, wherein the at least one rotational target wheel is connected to a drive shaft of a hydraulic motor, and wherein the hydraulic motor is configured to drive the feeding device.

9. The rock drilling unit according to claim 5, wherein the at least one rotational target wheel is connected to an elongated frame or beam of the rock drilling unit or on the feeding device, and wherein the at least one rotational target wheel is configured to be driven by the motion of the feeding device in relation to the elongated frame or beam.

10. A rock drilling rig comprising the rock drilling unit according to claim 5.

11. The rock drilling unit according to claim 5, wherein the control device is configured to determine the axial direction of the feeding device based on the rotational motion of the at least one rotational target wheel.

* * * * *